United States Patent [19]

Nygren

[11] 4,076,254

[45] Feb. 28, 1978

[54] GOLF CLUB WITH LOW DENSITY AND HIGH INERTIA HEAD

[76] Inventor: Gordon W. Nygren, 321 Spring Valley Dr., Bloomington, Minn. 55420

[21] Appl. No.: 674,456

[22] Filed: Apr. 7, 1976

[51] Int. Cl.[2] ..... A63B 53/04

[52] U.S. Cl. ..... 273/173; 273/167 R; 273/171

[58] Field of Search ..... 273/77 R, 78, 80.2, 273/167–174

[56] References Cited

U.S. PATENT DOCUMENTS

| | | | |
|---|---|---|---|
| 1,091,231 | 3/1914 | Millar | 273/169 |
| 1,446,577 | 2/1923 | Nix | 273/171 |
| 1,504,326 | 8/1924 | Cullinan | 273/169 |
| 1,515,390 | 11/1924 | Hubbard | 273/77 R X |
| 1,543,691 | 6/1925 | Beat | 273/167 F X |
| 1,678,637 | 7/1928 | Drevitson | 273/169 |
| 2,346,617 | 4/1944 | Schaffer | 273/173 X |
| 2,880,002 | 3/1959 | Wetty | 273/167 R X |
| 3,212,783 | 10/1965 | Bradley et al. | 273/167 F X |
| 3,218,072 | 11/1965 | Burr | 273/169 X |
| 3,567,228 | 3/1971 | Lynn | 273/173 X |
| 3,659,855 | 5/1972 | Hardesty | 273/173 |
| 3,817,522 | 6/1974 | Simmons | 273/167 J X |
| 3,847,399 | 11/1974 | Raymont | 273/167 F |
| 3,897,066 | 7/1975 | Belmont | 273/171 |

FOREIGN PATENT DOCUMENTS

| | | | |
|---|---|---|---|
| 7,279 of | 1901 | United Kingdom | 273/167 F |
| 7,287 of | 1908 | United Kingdom | 273/169 |

*Primary Examiner*—Richard J. Apley
*Attorney, Agent, or Firm*—Stuart R. Peterson

[57] ABSTRACT

The golf club has a head of composite construction which includes a specially configured metal insert encased in a plastic matrix. The insert comprises an aluminum or magnesium face plate, relatively thin corrugated ribs or plates on the same metal extending rearwardly therefrom, and a transversely disposed block of lead cast onto the rear ends of the ribs or plates, the lead block containing therein a stack of individually removable heavy discs, preferably of a tungsten alloy, that further increases the mass at the rear of the insert. The face plate and corrugated plates, which are of aluminum or magnesium, constitute a relatively low density metal, but the plastic matrix, which is molded about the insert, is of a much lower density, the plastic constituting rigid or structural foamed polyurethane. The ribs or plates, which are corrugated to achieve a high stiffness-to-weight ratio, are perpendicular to the face plate for the purpose of transmitting energy from the face plate to the rearwardly disposed heavy mass composed of the lead block and tungsten-containing discs. Access to the heavy discs is had in one embodiment via the back side of the club head and in a second embodiment via the bottom sole plate so that the mass can be changed, either by adding or removing the appropriate number of discs.

20 Claims, 9 Drawing Figures

GOLF CLUB WITH LOW DENSITY AND HIGH INERTIA HEAD

BACKGROUND OF THE INVENTION

1. Field of the Invention

This invention relates generally to golf clubs, and pertains more particularly to a club having a head providing both maximum efficiency of energy transmission using a material with a high modulus of elasticity and optimum moment of inertia.

2. Description of the Prior Art

Various attempts have been made to weight golf club head, particularly with respect to locating the weight directly behind the intended point of ball impact or sweet spot. One prior attempt is depicted in U.S. Pat. No. 1,091,231, granted Mar. 24, 1914 to James Miller. In this arrangement, both the forwardly disposed face plate constitutes one weight member and a rearwardly located cylindrical member constitutes a second weight member, being threaded onto a stud extending rearwardly from the face plate. The aim of the alluded to patent is to locate the two weights symmetrically with respect to the club shaft axis. No effort is made to concentrate the mass as far rearwardly as possible, the objective instead being merely to balance the weight in a fore and aft direction, although the second weight is intended to be directly behind the point of ball impact. Because of the early date (1914) of this patent, it is presumed that the material for the club head (with the exception of the parts just referred to) is wood.

Another effort to locate the weight directly behind the intended point of impact is illustrated in U.S. Pat. Nos. 2,346,617 and 2,460,435, granted on Apr. 11, 1944 and Feb. 1, 1949, respectively, to Fred B. Schaffer. In both of these instances, a core construction is utilized which also has the end result of disposing approximately half the weight forwardly and half rearwardly of the club shaft. The metal parts in these cases are embedded in a plastic material.

The common shortcomings of the several types of patented golf club heads, however, is that the mass of the club head is balanced forwardly and rearwardly of the club shaft. No attempt is made to concentrate the mass at a maximum distance from the club face to provide a maximum moment of inertia. Also, no thought is given in any of the three patents to specifically concentrating the mass behind the hitting area and still maintain the same total weight by use of a low density material for imparting the conventional shape or curvature to the head's exterior surface.

SUMMARY OF THE INVENTION

Accordingly, one object of the present invention is to provide a golf club employing a head possessing a relatively low density and a relatively high moment of inertia. More specifically, it is planned that the club head contain therein an insert of low density metal encased in a much lower density plastic material, a relatively heavy weight being provided by the insert at the extreme rear of the head so as to concentrate more mass as far away from the face plate as possible.

Another object of the invention is to concentrate the mass of the club head directly rearwardly of the intended point of ball impact so that when the ball is hit directly at the best point or so-called "sweet spot", all forces developed by the forwardly moving mass are transmitted through the metal insert to the face place, resulting in a more efficient transfer of energy when compared to wood which absorbs a lot of the impact energy. It is also an aim of the invention to improve the overall striking capability of the club when the face plate strikes the ball at points offset from the best point or "sweet spot". In this regard, the invention employs corrugated slates in the insert construction, the longitudinal direction of the corrugations being perpendicular to the face plate . The corrugated slates are relatively wide immediately adjacent the face plate but narrow as they extend rearwardly so that the rearwardly disposed concentration of mass acts over virtually the entire area of the face plate. State somewhat differently, the "feel" of the club is enhanced even though the ball is struck at a point displaced from the sweet spot or intended point of impact.

Yet another object of the invention is to provide a golf club of the foregoing character in which the amount of the rearwardly disposed mass can be easily varied within practical limits so as to obtain a desired or preferred swing weight for the particular golfer using the club.

Still another object is to provide for varying the amount of weight in an extremely simple manner such that the aesthetic or cosmetic characteristics of the club head are not adversely affected. In one embodiment accesss is made to the weight contained within the club head via the back side of the head, and in another embodiment the access is had to the weight through the bottom sole plate.

Still further, an object of the invention is to provide for the secure attachment of the golf club shaft to the head, yet enabling either to be removed and replaced should circumstances so dictate.

A further object is to provide a golf club that can be manufactured quite inexpensively, the invention permitting its production in either large or small quantities through simple molding techniques. Also, it is within the purview of the invention to provide a golf club in which its head is fabricated from relatively inexpensive materials.

Briefly, my invention comprises a golf club utilizing a head having therein a relatively low density metal insert about which is molded a matrix of low density structural foamed plastic, the even lower density of this plastic material enabling the mass of the club to be concentrated as far rearwardly with respect to the face plate as possible. In the achieving of the rearward disposition of the mass, the insert, in addition to the face plate, includes a plurality of on plates, which are spaced one above the other, and extend perpendicularly from the rear side of the forwardly disposed face plate to the rearwardly disposed mass comprising an elongated lead block which extends transversely across the rear of the club head and a stack of tungsten-containing discs contained in said block. The corrugated ribs on slates impart a high stiffness-to-weight ratio, transferring maximum energy from the rear mass to the face plate. Access is had to the stack of discs contained in the transversely oriented lead block either through the rear of the club head or through the bottom thereof. The various ribs on plates also permit a secure anchoring of the lower end of the club shaft, the club shaft extending at an angle through the various ribs on plates as well as the rigid foamed plastic.

DESCRIPTION OF THE PREFERRED EMBOIDMENTS

Figure 1:
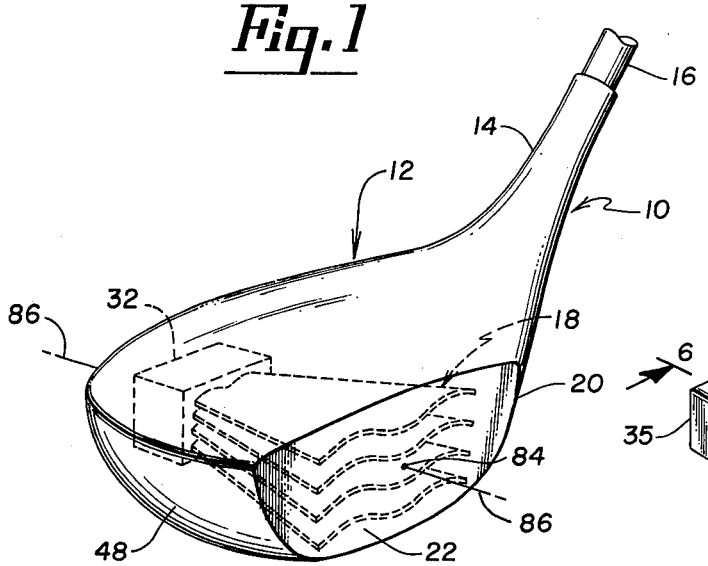
FIG. 1 is a perspective view of a golf club exemplifying my invention, the insert contained therein being shown in dashed outline and the shaft anchored thereto being fragmentarily shown.
Figure 5:
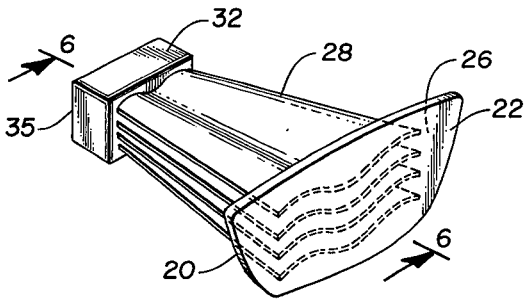
FIG. 5 is a perspective view of the metallic insert oriented in the same spatial relation it assumes in FIG. 1.
Figure 2:
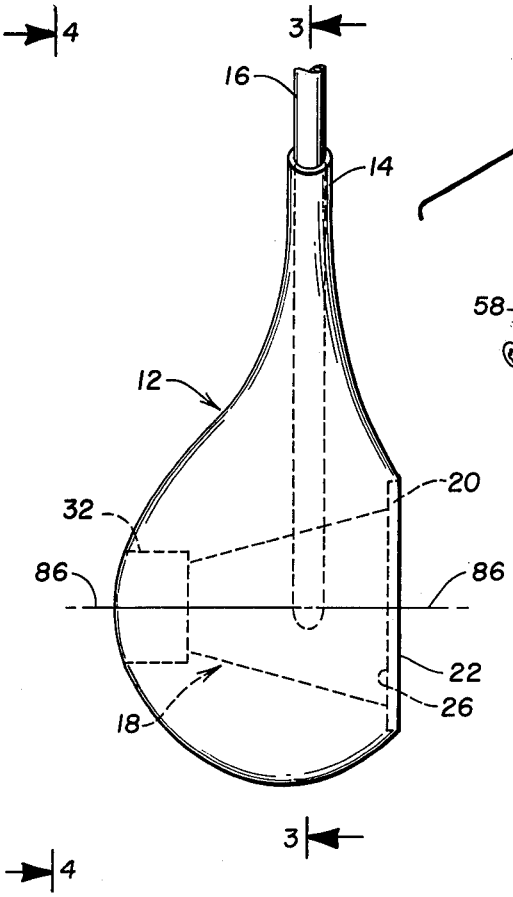
FIG. 2 is a top plan view of the club head, the insert contained therein again being depicted in dashed outline.

Referring first to the embodiment illustrated in FIGS. 1–7, the golf club exemplifying my invention has been denoted generally by the reference numeral 10, the golf club 10 comprising a head 12, a hosel 14 integral therewith, and a shaft 16 extending upwardly from the head through the hosel, only the lower end portion having been depicted.

Playing an important role in the practicing of my invention is a metallic insert indicated generally by the reference numeral 18. It will be discerned that the insert 18 includes a face plate 20 having front and back sides 22 and 26, the front side providing a ball striking surface. Extending rearwardly from the back side 26 of the face plate 20 are four (in the illustrated situation) corrugated metal ribs on plates 28, the corrugated effect being best seen in FIGS. 3 and 5. The forward ends of the ribs on plates 28 are relatively wide and their rear ends relatively narrow, the side edges of these elements converging as they extend rearwardly.

It is important to note that the plates 28 are arranged perpendicularly to the general plane of the face plate 20 and that the lengthwise direction of the corrugations is also perpendicular to the face plate 20. Also, it is important to observe that these plates 28 are spaced one above the other. From FIG. 6 it will be seen that the vertical spacing of the plates 28 is somewhat greater at their forward ends, than at the rear.

Figure 6:
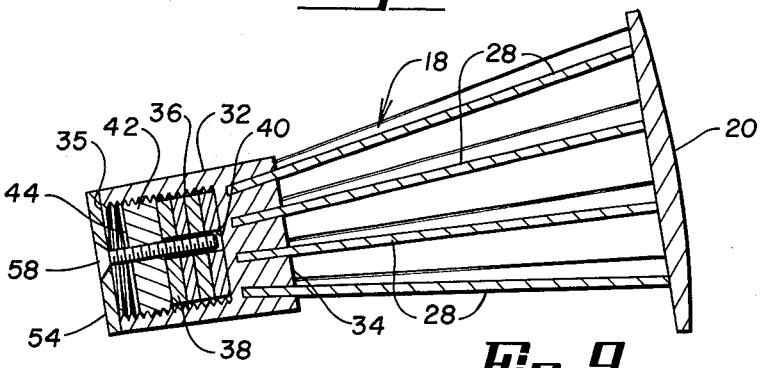
FIG. 6 is a sectional view taken in the direction of line 6—6 of FIG. 5.

The insert 18 also comprises a transverse lead block 32 having a front side 34. The rear ends of the ribs 28 are received in this block, as can be seen in FIG. 6. Whereas, the relatively wide forward ends of the plates 28 are secured to the back side 26 of the face plate 20 by means of a suitable adhesive, the relatively narrow rear ends of the plates 28 are cast into the lead block 32, extending inwardly through its front side 34 in order to provide an insert 18 of unitary and rigid construction. Although the face plate 20 and corrugated plates 28 of the insert 18 are of relatively low density metal, such as aluminum or magnesium as already mentioned, the block 32 is of lead, as already mentioned, which is relatively high density metal.

Figure 7:
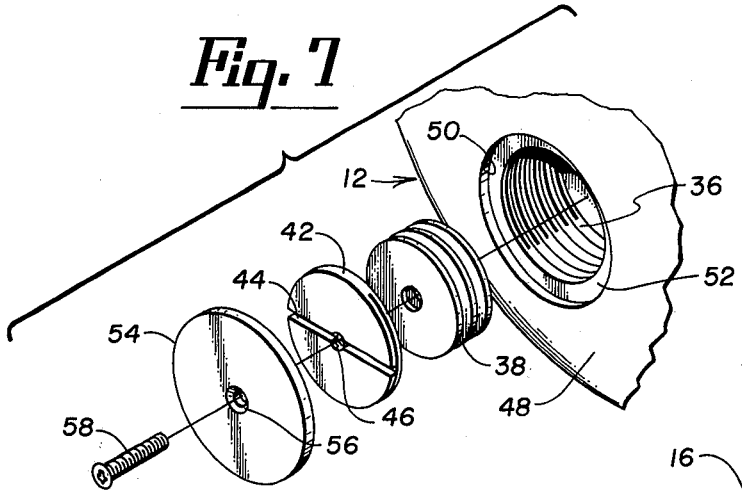
FIG. 7 is an exploded perspective view of depicting the arrangement for adjusting the amount of mass at the rear of the head.

From FIGS. 6 and 7 it will be observed that a tapped hole 36 extends forwardly from the back side 35 of the transverse lead block 32. Contained within the tapped hole 36 is a number of annular discs 38 of heavy metal, such as a readily available tungsten alloy which is less expensive than pure tungsten although still much heavier per unit volume than lead, each disc 38 having a centrally disposed hole 40 therein. The various discs 38 are held in place by a threaded retainer 42 having a screwdriver slot 44 (best seen in FIG. 7) extending thereacross so that it can be advanced within the threads of the hole 36 so as to bear tightly against the rearmost disc 38. The retainer 42 is provided with a central hole 46 (also best seen in FIG. 7), the hole 46 being tapped for a purpose hereinafter explained.

In order to impart the desired aerodynamic characteristics to the club head 12, the insert 18 has molded thereabout a matrix 48 of rigid foamed plastic, polyurethane having been found to be especially suitable since it has a density less than the aluminum or magnesium used for the elements 20, 28; actually foamed polyurethane has only 1/10 the weight of aluminum and 1/6 the weight of magnesium. The rigid foamed plastic 48 extends rearwardly from the upper, lower and side edges of the face plate 20 and completely encases the plates 28 and the transverse block 32.

Access to the retainer 42 and hence to the annular discs 38 is through an opening 50 (FIG. 4) in the rigid foamed polyurethane 48 that can be forme during the molding procedure or drilled thereafter. The opening 50 has an annular shoulder 52. In order to close the opening 50, a cover plate 54 is employed, the plate 54 having an untapped or unthreaded hole centrally disposed therein for the accommodation of a retaining screw 58. It should now be apparent that the screw 58 extends through the hole 46 in the retainer 42, thereby holding the cover plate against the shoulder 52. The cover plate 54 is easily removed by taking out the screw 58. Then, a screwdriver can be inserted in the slot 44 of the retainer 42 to untwist and remove the retainer. Once the retainer 42 has been removed from the tapped hole 36, any desired number of the annular discs 38 can be taken out in order to vary the weight or mass at the rear of the club head 12.

Figure 8:
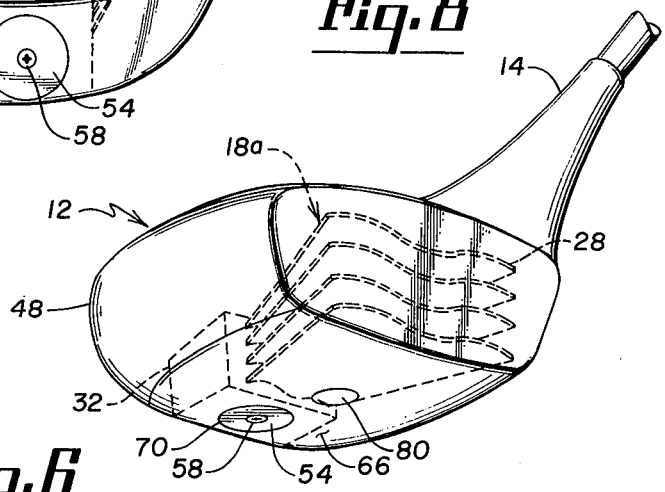
FIG. 8 is a perspective view of a club head utilizing a bottom access to the weight located at the rear of the insert contained within the club head.
Figure 9:
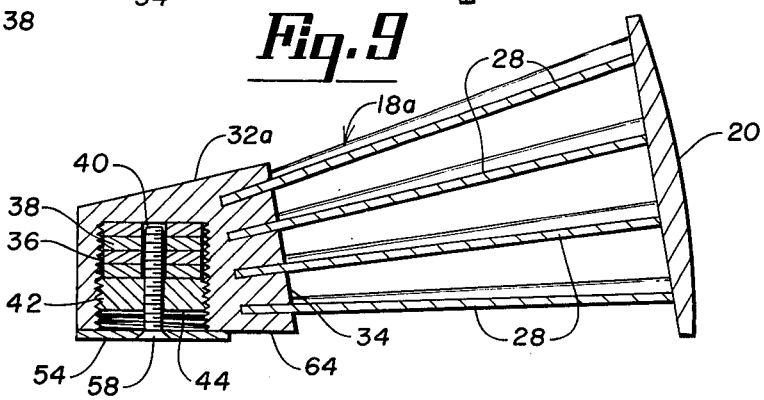
FIG. 9 is a sectional view corresponding to FIG. 6 but illustrating the bottom access mode utilized in FIG. 8.

The use of the cover plate 54 does not noticeably detract from the aesthetic appearance of the club head 12; actually, it can be quite decorative and it is planned that it be of brass in most instances. However, in order to provide a choice as to how the cosmetic effect of the head 12 is to be preserved, a somewhat modified version of the invention is shown in FIGS. 8 and 9, the insert **18*a* appearing in FIG. 9 having been distinguished from the insert 18 of FIG. 6** by the suffix "*a*". In FIGS. 8 and 9, it is planned that the threaded hole 36 be located on a vertical axis extending into the lead block 32 from its bottom side 64. Thus, instead of having the tapped hole 36 extend from the back side 35 of the transverse block 32 as done in FIG. 6, it extends upwardly from the bottom side 64 in the embodiment of FIGS. 8 and 9. The club head 12 has a sole plate 66 covering the bottom side 68 of the head 12. The access opening 70 is provided in the sole plate 66 as can be seen in FIG. 8. The cover plate 54 in the embodiment now being described simply fits into the access opening 70 and seats against the plastic surrounding a hole (not visible) leading upwardly through the bottom portion of the matrix 48, thereby closing this hole when the cover plate 54 is in place. The screw 58 is taken out and the cover plate 54 is removed so as to permit a screwdriver to be inserted into the slot 44 of the retainer 42 in the same fashion as in the previously preferred to arrangement. Thus, when any of the annular discs 38 are to be added or removed in the embodiment of FIGS. 8 and 9, virtually the same procedure of doing so is followed as in the embodiment of FIGS. 1–7.

The shaft 16 is secured to the club head 12 by means of a sleeve 74 that is preferably molded into the matrix 48 at the time the matrix is molded. Since it is intended that the sleeve 74 extend angularly down through the plates 28 (see FIG. 3) of the insert 18 (or 18*a*), it is necessary to drill through the various plates 28 so that the lower portion of the sleeve 74 can be accommodated therein prior to initiating the molding procedure. The sleeve 74, being tubular, is then reamed, using a tapered reamer, in order to receive therein the lower end portion of the shaft 16. In other words, the bore of the sleeve 74 should have the same degree of taper as does the shaft 16. Thus, the lower end of the sleeve 74 will possess a slightly smaller diameter than the upper end of the sleeve 74. If desired, the sleeve 74 can be inserted after the matrix 48 has been molded, it then being necessary to drill a hole through the hosel 14 downwardly at the proper angle and through the bottom side 68 of the matrix 48. The sleeve 74 in such a case can then be retained within the drilled passage by means of a suitable adhesive.

Irrespective of whether the sleeve 74 is molded in situ or added after the molding, it is preferable that a set screw 76 extend through a small hole 78 near the lower end of the sleeve 74 into the plastic matrix 48. This assures that the head will not fly off the shaft 16 during a golf swing. The opening at the bottom of the sleeve 74 is preferably plugged with an appropriate plastic filler so as to blend in with the metallic appearance of the sole plate 66, the filled in portion being labeled 80. This filled in material 80 is scraped away in order to provide access to the set screw 76 and also to the lower end of the shaft 16.

Should the shaft 16 have to be removed, after the filled in material 80 has been taken out and also the set screw 76, then a twisting of the shaft 16, after some heating, relative to the head 12 will break loose any adhesive holding the shaft 16 within the sleeve 74. Should it become difficult to dislodge the shaft 16 from the sleeve 74 by the twisting action just alluded to, an appropriately blunt instrument, such as a rod, can be inserted upwardly through the lower end of the sleeve 74 so as to force the shaft 16 upwardly in the achieving of the reshafting.

Figure 3:
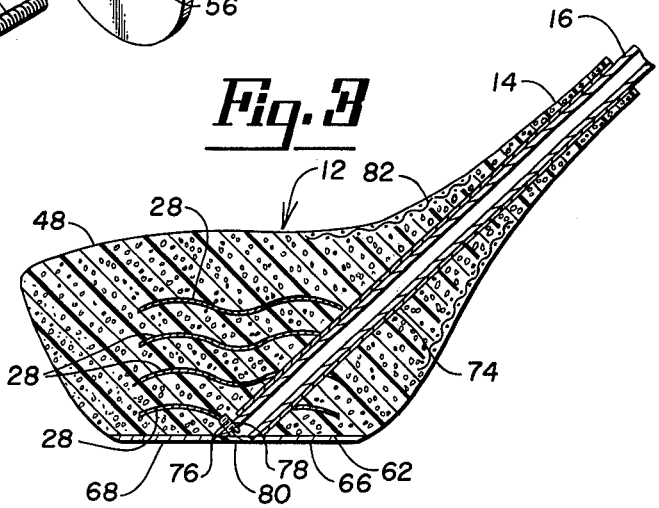
FIG. 3 is a sectional view taken in the direction of line 3—3 of FIG. 2.
Figure 4:
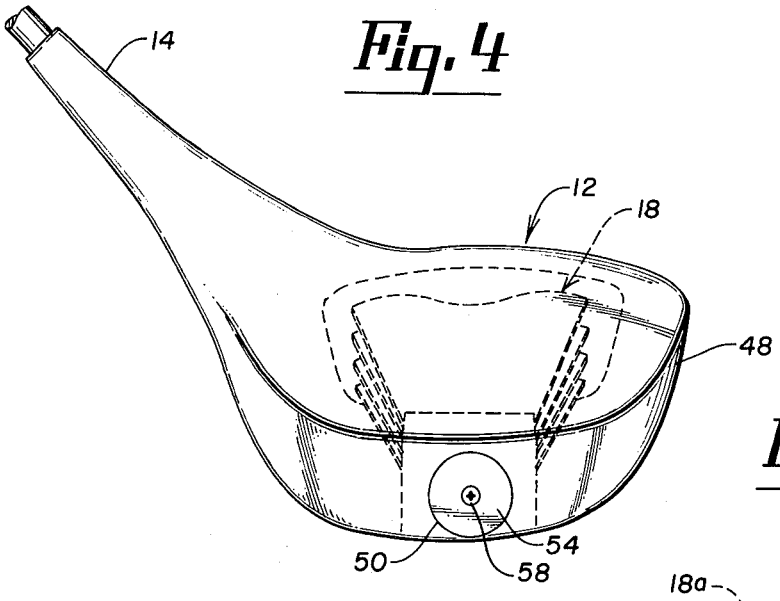
FIG. 4 is a rear view of the club head, the view being taken in the direction of line 4—4 of FIG. 2 in order to illustrate how access is had through the rear of the club head to the weight carried at the rear of the embedded insert.

In order to impart additional strength to the club head 12 where the hosel 14 merges into what has been referred to as the matrix portion of the head 12, a section of fiber glass mat 82 can be placed in the mold when forming the head 12, this mat appearing in section in FIG. 3.

In use, it will be appreciated that when the golfer swings, the best point of impact or sweet spot labeled 84 will be directly ahead of the concentrated mass provided by the rearwardly located stack of heavy discs 38. A line 86 composed of alternating dots and dashes has been added to FIGS. 1 and 2, and it will be seen that this line extends at approximately right angles to the longitudinal axis of the shaft 16. As illustrated in FIG. 1, the exact center of the surface 22 is the best point to strike the ball, this being the point assigned the reference numeral 84.

When the ball is struck, the rearward location of the annular discs 38, and the lead block 32, being spaced as far rearwardly as possible from the face plate 20, provide the greatest possible moment of inertia, since the moment of inertia increases with the square of the distance or spacing. The appreciably lower density of the foamed polyurethane 48 has little effect on the overall inertia, yet provides the required aerodynamic shape or head configuration in that its specific weight is approximately 0.3 in contrast to 2.7 for aluminum, 1.7 for magnesium and 18.5 for the tungsten alloy. An excellent tungsten alloy is marketed by Kennametal Inc., Latrobe, Pa. 15650 under the registered trademark "Kennertium". Grade W-2 contains 97.4% W and 2.6% Ni, Co, Fe. The specific weight for conventional woods used in golf club heads is 0.63.

While a golfer's goal is to hit the ball at the sweet spot 84, in practice this does not always occur, for the ball will at times be struck to one side or the other of the sweet spot 84 and, of course, sometimes above or below (and at various angles in between), the proximity to the sweet spot 84 depending upon the proficiency of the golfer. Since the plates 28 are relatively wide adjacent the face plate 20, it follows that the weight or mass furnished by the lead block 32 and the even denser annular discs 38 is effective over a larger area of the striking surface 22 than if only a single stud or shank provided the transmitting path. In other words, the effective mass, even though concentrated at the rear, is distributed over a much larger area of the surface 22 measured in all directions from the true sweet spot 84. It will be appreciated that when practicing the teachings of my invention the maximum percentage of the total weight of the head 12 is behind the sweet spot 84 and along the axis 86 which extends perpendicularly to the face plate 20.

Once the ball is struck, then if the point of impact is to the left, say, of the sweet spot 84 appearing in FIG. 1, then the component of the reactive force is still transmitted via the plates 28 back to the concentrated mass, the major portion of which is provided by the heavy stack of discs 38. Not only is the reaction transmitted rearwardly through the plates 28 but any vibrational forces are dampened by reason of the rigid foamed plastic 48 which envelopes the entire insert 18. Of course, the corrugated configuration imparted to the plates 28 provides a high stiffness-to-weight relation which minimizes the amount of vibration to begin with. Experienced golfers recognize a particular sound or click when the ball is correctly struck, and the present invention, owing to the construction that has been described, provides an optimum clicking sound in addition to the excellent transmission of impact forces within the golf club head.

It is important to appreciate that my golf club 10 enables the golfer or pro to vary the weight or mass in the head 12 to suit the individual. It is planned that the hole 36 be filled with annular discs 38 at the factory, thereby providing the greatest mass, and the appropriate number of discs 38 later be removed via the procedure already explained in order to provide just the right amount of weight or mass for the specific golfer who will be using the club. One nicety about my invention is that the weight can be changed so readily that any number of "trial and error" changes can be made until the exact "feel" is realized.

I claim:

1. In a golf club, a head comprising a face plate, weight means spaced rearwardly from said face plate, a plurality of spaced plates, each of said plates extending from said face plate to said weight means, and material encasing said plurality of plates and said weight means to form an aerodynamically curved outer surface.

2. A golf club in accordance with claim 1 in which said face plate, plurality of plates and weight means are of metal and said encasing material is of rigid foamed plastic.

3. A golf club in accordance with claim 2 in which said face plate and plurality of plates are of relatively low density metal and said weight means is of relatively high density metal, and said plastic material has a density appreciably less than said face plate and plurality of plates.

4. A golf club in accordance with claim 3 in which said face plate and plurality of plates are of aluminum or magnesium, said weight means is of lead and a heavier tungsten alloy, and said plastic material is of foamed polyurethane.

5. A golf club in accordance with claim 3 in which said weight means includes a transverse lead block and a plurality of discs containing tungsten disposed therein.

6. A golf club in accordance with claim 1 in which said plurality of plates are anchored to and extend generally at right angles from said face plate.

7. A golf club in accordance with claim 6 in which said plurality of plates are spaced one above the other.

8. A golf club in accordance with claim 7 in which said plurality of plates are corrugated.

9. A golf club in accordance with claim 8 in which the forward ends of said plurality of plates are wider than their rear ends.

10. A golf club in accordance with claim 9 in which said weight means includes a transversely oriented block and the rear ends of said plurality of plates are anchored to said block.

11. A golf club in accordance with claim 10 in which said weight means additionally includes a plurality of discs, said block containing a centrally located hole containing said discs.

12. A golf club in accordance with claim 11 in which said face plate and plurality of plates are formed of relatively low density metal and said block and discs are formed of relatively high density metal carried in said block.

13. A golf club in accordance with claim 12 in which said encasing material is formed of relatively low density foamed polyurethane.

14. A golf club in accordance with claim 8 including a shaft, the lower end of said shaft extending through said plurality of plates.

15. A golf club in accordance with claim 11 in which said hole extends forwardly from its rear side of said block for receiving said discs therein.

16. A golf club in accordance with claim 11 in which said hole extends upwardly from its bottom side of said block for receiving said discs therein.

17. A golf club comprising a shaft and head, said head including structural foamed polyurethane forming an aerodynamically configured outer surface, a metal insert embedded in said polyurethane, said insert including an aluminum or magnesium face plate, rearwardly extending corrugated aluminum or magnesium plates having their forward edges adhered to the back side of said face plate and a transversely oriented lead block, the rear ends of said corrugated plates being embedded in said lead block, said block having a tapped hole therein, a plurality of annular discs containing tungsten disposed in said hole for concentrating the mass of the head at a rearwardly spaced location with respect to said face plate, and a retainer threadedly engaged in said tapped hole for retaining said discs therein, the lower end portion of said shaft extending downwardly through said polyurethane into the corrugated plates of said insert at a location between said face plate and said lead block.

18. A golf club in accordance with claim 17 in which said retainer has a tapped hole, the golf club further including a cover plate having a hole, and a screw extending through said cover plate hole into the tapped hole in said retainer.

19. A golf club in accordance with claim 17 in which said tapped hole extends horizontally into said transverse block from the rear side of said block.

20. A golf club in accordance with claim 17 in which said tapped hole extends upwardly into said transverse block from the bottom side of said block.

* * * * *

UNITED STATES PATENT OFFICE

CERTIFICATE OF CORRECTION

Patent No. 4,076,254 Dated February 28, 1978

Inventor(s) Gordon W. Nygren

It is certified that error appears in the above-identified patent and that said Letters Patent are hereby corrected as shown below:

In the Abstract: line 5, "on" should be --of--.

In the Specification:

Column 1, line 14, "head," should be "heads,"; line 17, "Miller" should be --Millar--; line 69, "place," should be --plate,--.

Column 2, line 7, "slates" should be --plates--; line 9, "slates" should be --plates--; line 52, "on plates" should be --corrugated ribs or plates--; line 58, "on plates" should be --or plates--; line 65, "on" should be --or--; line 67, "on" should be --or--.

Column 3, line 32, "EMBOIDMENTS" should be --EMBODIMENT--; line 47, "on" should be --or--; line 49, "on" should be --or--; line 61, "ribs" should be --plates--.

Column 4, line 41, "through the hole 46" should be --through the hole 56 into the threaded hole 46--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*